US011161355B1

(12) United States Patent
McConville et al.

(10) Patent No.: US 11,161,355 B1
(45) Date of Patent: Nov. 2, 2021

(54) MEDIA TRANSPORT THROUGH A DRYER THAT ATTENUATES THERMAL ARTIFACTS IN IMAGES ON SUBSTRATES PRINTED BY AQUEOUS INK PRINTERS

(71) Applicant: Xerox Corporation, Norwalk, CT (US)

(72) Inventors: Paul J. McConville, Webster, NY (US); Linn C. Hoover, Webster, NY (US); Anthony S. Condello, Webster, NY (US); Jason M. LeFevre, Penfield, NY (US); Seemit Praharaj, Webster, NY (US); Douglas K. Herrmann, Webster, NY (US); David A. VanKouwenberg, Avon, NY (US); Chu-Heng Liu, Penfield, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/923,802

(22) Filed: Jul. 8, 2020

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

| | | | | |
|---|---|---|---|---|
| 6,328,440 | B1 * | 12/2001 | Medin | B41J 11/007 347/102 |
| 2002/0067403 | A1 | 6/2002 | Smith | |
| 2002/0071017 | A1 | 6/2002 | Pitpit et al. | |
| 2007/0247505 | A1 | 10/2007 | Isowa et al. | |
| 2015/0029281 | A1 | 1/2015 | Cressman et al. | |
| 2015/0091996 | A1 | 4/2015 | Piatt et al. | |
| 2015/0165790 | A1 | 6/2015 | Rosati et al. | |
| 2015/0375533 | A1 | 12/2015 | Hobo et al. | |
| 2016/0060052 | A1 | 3/2016 | Tojima et al. | |
| 2016/0067985 | A1 | 3/2016 | Akahiri et al. | |

* cited by examiner

*Primary Examiner* — Bradley W Thies
(74) *Attorney, Agent, or Firm* — Maginot Moore & Beck LLP

(57) ABSTRACT

An inkjet printer includes a dryer configured to attenuate the effects of temperature differentials arising in substrates that are caused by holes in a media transport belt and a platen covering a vacuum plenum. The dryer includes a platen, a heater configured to direct heat toward the platen, at least one media transport belt configured to slide over the platen to move the substrates past the heater after the ink images have been formed on the substrates, and at least one belt diversion component configured to divert the at least one media belt from a straight-line path over the platen.

20 Claims, 5 Drawing Sheets

MEDIA TRANSPORT THROUGH A DRYER THAT ATTENUATES THERMAL ARTIFACTS IN IMAGES ON SUBSTRATES PRINTED BY AQUEOUS INK PRINTERS

TECHNICAL FIELD

This disclosure relates generally to aqueous ink printing systems, and more particularly, to media transport belts that carry media through dryers in such printers.

BACKGROUND

Known aqueous ink printing systems print images on uncoated and coated substrates. Whether an image is printed directly onto a substrate or transferred from a blanket configured about an intermediate transfer member, once the image is on the substrate, the water and other solvents in the ink must be substantially removed to fix the image to the substrate and enable contact between the image and subsequent paper transport rollers without adverse impact to the image. A dryer is typically positioned after the transfer of the image from the blanket or after the image has been printed on the substrate for removal of the water and solvents. To enable relatively high speed operation of the printer, the dryer heats the substrates and ink to temperatures that typically reach well above 100° C. for effective removal of the liquids from the surfaces of the substrates.

Typical dryers include a plurality of media transport belts that carry substrates through the dryer or dryers in a printer. The belts pass over a perforated platen covering a vacuum plenum. The platen helps support the belts and the substrates on the belts. Some known belts have holes so as the belt passes over the perforated platen covering the vacuum plenum, a vacuum can exert a pull on the media substrates through the perforated platen and the holes in the belt to acquire and hold the substrates in position for drying. The substrate areas that are adjacent the holes in the belt are cooler than the substrate areas adjacent the belt material because the void in the belt does not transfer heat energy to the back side of the substrate as the belt material does. The resulting temperature differential between these two types of areas in the substrates produces the image defects shown in FIG. 5. As shown in the figure, the darker circles to which the arrows point are the areas that were adjacent the holes of the media transport belt. The steady-state temperature of the belt is much hotter and has much better thermal conduction to the substrate than the hole between the belt and media back side. This increased thermal conduction produces a temperature differential on the media surface. The water and solvents evaporate more quickly in these areas resulting in a higher concentration of ink pigments and dyes there. The ink pigments and dyes are drawn from surrounding areas in the image and lighter density boundaries arise where the temperature was cooler. As shown in the figure, the lighter circles within the darker circles are the areas that were adjacent the holes in the media transport belt.

As noted above, some dryers have an arrangement of a plurality of belts that pass over the perforated platen covering the vacuum plenum. Each belt is narrower than a width of the media carried by the belt in the cross-process direction so the belts are separated from one another in the cross-process direction. Thus, portions of the platen between the belts are thermally insulated from the heat produced by the heating elements by the substrates and the air adjacent these platen portions. Inter-document gaps between successive media substrates in the process direction are not covered by the substrates so these areas of the belts and platens are exposed to the heating elements. Consequently, these areas of the belts and platen absorb more heat than the areas covered by the substrates, particularly when the heating elements are infrared (IR) emitters. Additionally, the material of which the belts are made absorb heat more readily than the metal material of which the platen is made so the exposed portions of the platen do not become as hot as the exposed portions of the belts. Since the substrates are not synchronized with the rotation of the media transport belt, an inter-document gap area of the belt during one revolution of the belt is covered by a substrate during a subsequent revolution of the belt. Thus, the heat from these heated portions of the belts eventually spreads in the belts so the temperatures of the belts become higher than the temperature of the air adjacent the areas of the platen between the belts in the cross-process direction. The higher temperature of the belts produces temperature gradients between the areas of the substrates contacting the belts and the areas of the substrates passing over the air adjacent to the platen. Temperature gradients greater than 10 degrees C. between these areas can cause the water and solvents in the ink on the substrates to evaporate at different rates. The non-uniformity of the evaporation rate can cause ink to flow on the substrate surface and concentrate pigments in the ink along the temperature gradient edges. The differing pigment concentration produces non-uniform images in solid density coverage areas. The darker lines extending in the process direction 112 in FIG. 5 show the effect of this temperature differential on either side of a straight-edged belt. Configuring a dryer to attenuate the temperature differentials between the media transport belts and the areas of the platen between the media transport belts would be beneficial.

SUMMARY

A new printer includes a dryer having belt diversion components that attenuate the temperature differentials between media transport belts and the areas of the platen between the media transport belts. The printer includes at least one printhead configured to eject drops of an ink onto substrates moving past the at least one printhead to form ink images on the substrates, and a dryer having a platen, a heater configured to direct heat toward the platen, at least one media transport belt configured to slide over the platen to move the substrates past the heater after the ink images have been formed on the substrates, and at least one belt diversion component configured to divert the at least one media belt from a straight-line path over the platen.

A new dryer for an aqueous ink printer includes belt diversion components that attenuate the temperature differentials between media transport belts and the areas of the platen between the media transport belts. The dryer includes a platen, a heater configured to direct heat toward the platen, at least one media transport belt configured to slide over the platen to move substrates past the heater after ink images have been formed on the substrates, and at least one belt diversion component configured to divert the at least one media belt from a straight-line path over the platen.

BRIEF DESCRIPTION OF THE DRAWINGS

The foregoing aspects and other features of a dryer having belt diversion components that attenuate the temperature differentials between media transport belts and the areas of the platen between the media transport belts are explained in the following description, taken in connection with the accompanying drawings.

DETAILED DESCRIPTION

Figure 1:
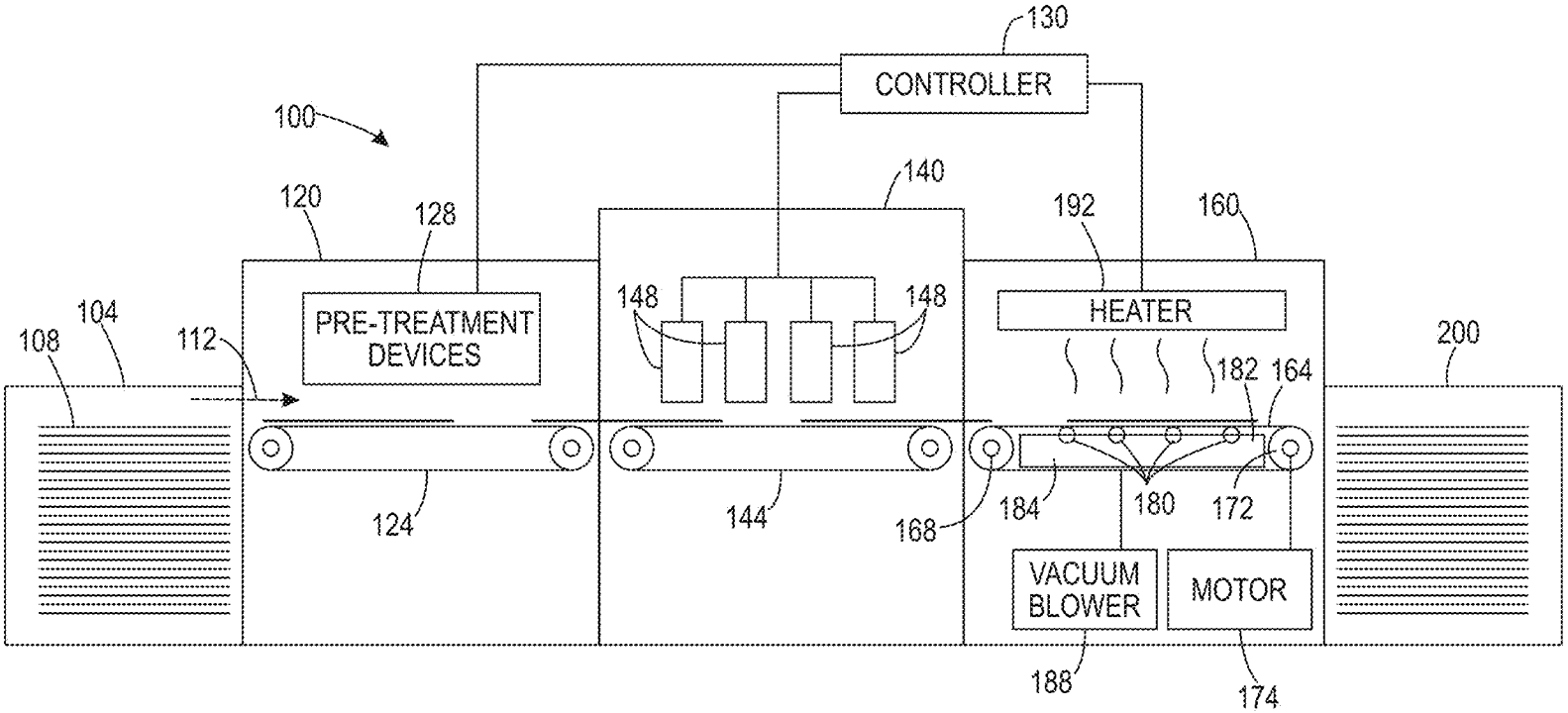
FIG. 1 is a schematic diagram of an aqueous ink printer having a dryer that includes belt diversion components that attenuate the temperature differentials between media transport belts and the areas of the platen between the media transport belts.

For a general understanding of the present embodiments, reference is made to the drawings. In the drawings, like reference numerals have been used throughout to designate like elements.

FIG. 1 depicts an aqueous printer 100 that has a dryer 160 configured with belt diversion components 180 to attenuate the temperature differentials between media transport belts 164 and the areas of the platen 182 between the media transport belts. The printer 100 includes a media supply 104, a pretreating unit 120, a marking unit 140, a dryer 160, and a media receptacle 200. The media supply 104 stores a plurality of media sheets 108 for printing by the printer 100. The media sheets 108 may, in some embodiments, be clay-coated or other types of treated paper.

The pretreating unit 120 includes at least one transport belt 124, which receives the media sheets 108 from the media supply 104 and transports the media sheets 108 in a process direction 112 through the pretreating unit 120. The pretreating unit 120 includes one or more pretreating devices 128 that condition the media sheets 108 and prepare the media sheets 108 for printing in the marking unit 140. The pretreating unit 120 may include, for example, one or more of coating devices that apply a coating to the media sheets 108, a drying device that dries the media sheets 108, and a heating device that heats the media sheets 108 to a predetermined temperature. In some embodiments, the printer 100 does not include a pretreating unit 120 and media sheets 108 are fed directly from the media supply 104 to the marking unit 140. In other embodiments, the printer 100 may include more than one pretreating unit.

The marking unit 140 includes at least one marking unit transport belt 144 that receives the media sheets 108 from the pretreating unit 120 or the media supply 104 and transports the media sheets 108 through the marking unit 140. The marking unit 140 further includes at least one printhead 148 that ejects aqueous ink onto the media sheets 108 as the media sheets 108 are transported through the marking unit 140. In the illustrated embodiment, the marking unit 140 includes four printheads 140, each of which ejects one of cyan, magenta, yellow, and black ink onto the media sheets 108. The reader should appreciate, however, that other embodiments include other printhead arrangements, which may include more or fewer printheads, arrays of printheads, and the like.

With continued reference to FIG. 1, dryer 160 includes a media transport belt 164 that receives the media sheets 108 from the marking unit 140. The media transport belt 164 in the dryer is tensioned between an idler roller 168 and a driven roller 172, which is driven by an electric motor 174. The dryer 160 is configured to expose the printed substrates to heat having an adequate temperature to remove the water and solvents in the aqueous ink on the substrates without producing image defects arising from temperature differentials in the substrates when the substrates are opposite the heater 192. To accomplish this goal, the platen 182 covering the plenum 184 is configured with media transport belt diversion components 180 as described in more detail below. The heater 192 is positioned within the dryer 160 to direct heat toward the substrates passing through the dryer 160. The heater 192 can be one or more arrays of various types of radiators of electromagnetic radiation, such as infrared (IR) radiators, microwave radiators, or more conventional heaters such as convection heaters. After passing through the dryer 160, the substrates are carried by the belt 164 to the output tray 200. The pre-treating unit 120, the marking unit 140, and the dryer 160 are operated by a controller 130. The controller is configured with programmed instructions stored in a memory operatively connected to the controller so the controller performs functions in the printer by operating various printer components when the controller executes the stored programmed instructions. Although only one controller is shown in FIG. 1 for simplicity, multiple controllers can be used for the various functions and these controllers can communicate with one another to synchronize the functions that they perform.

Figure 2:
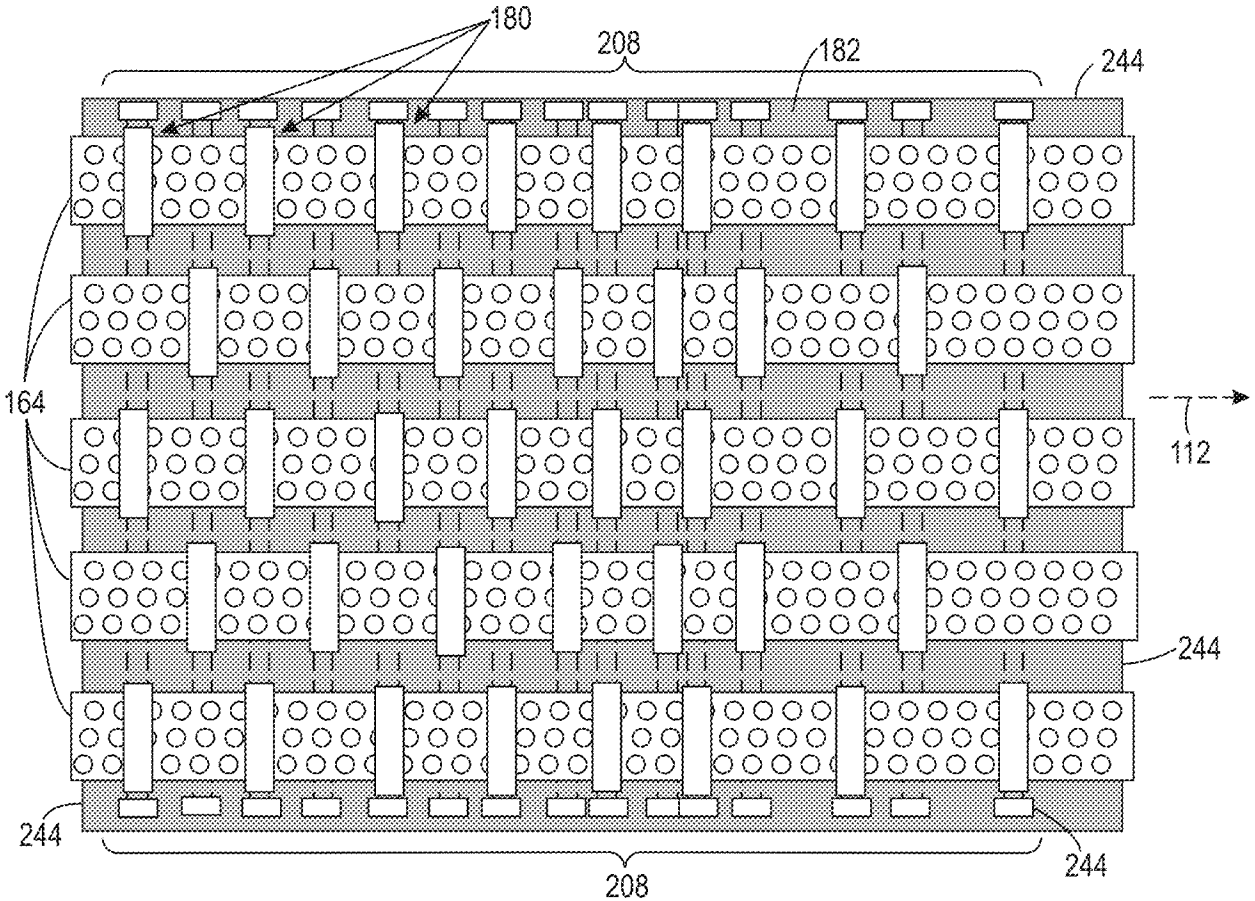
FIG. 2 is a top view of the media transport belts and the belt diversion components in the platen of the dryer of FIG. 1.
Figure 3:
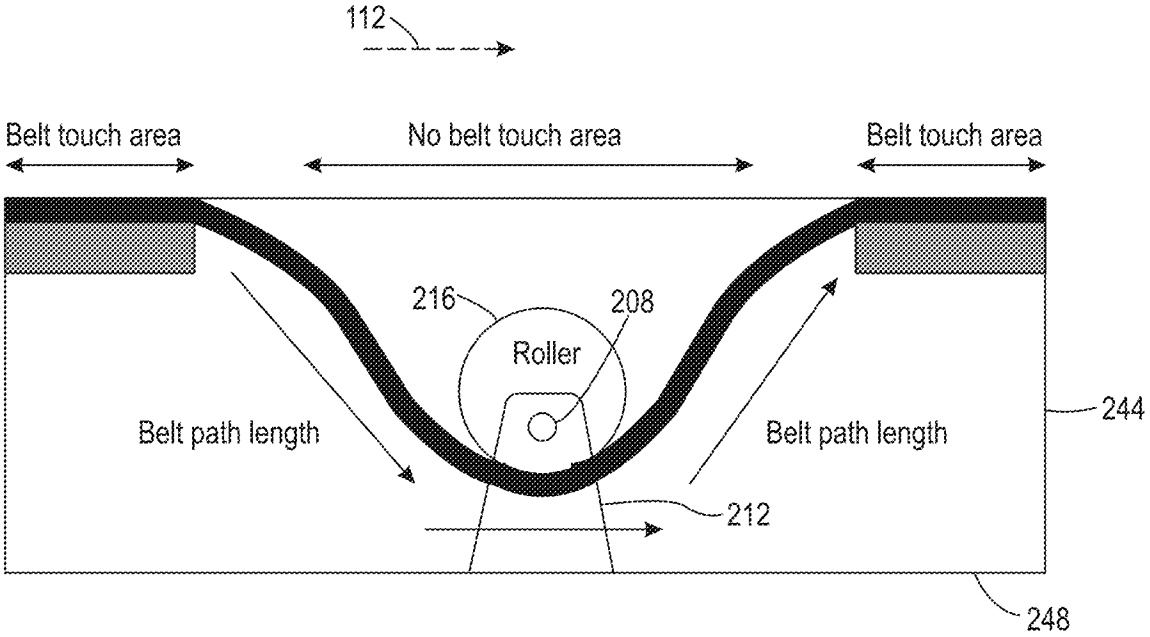
FIG. 3 is a side view of a belt diversion component in the dryer of FIG. 1.
Figure 5:
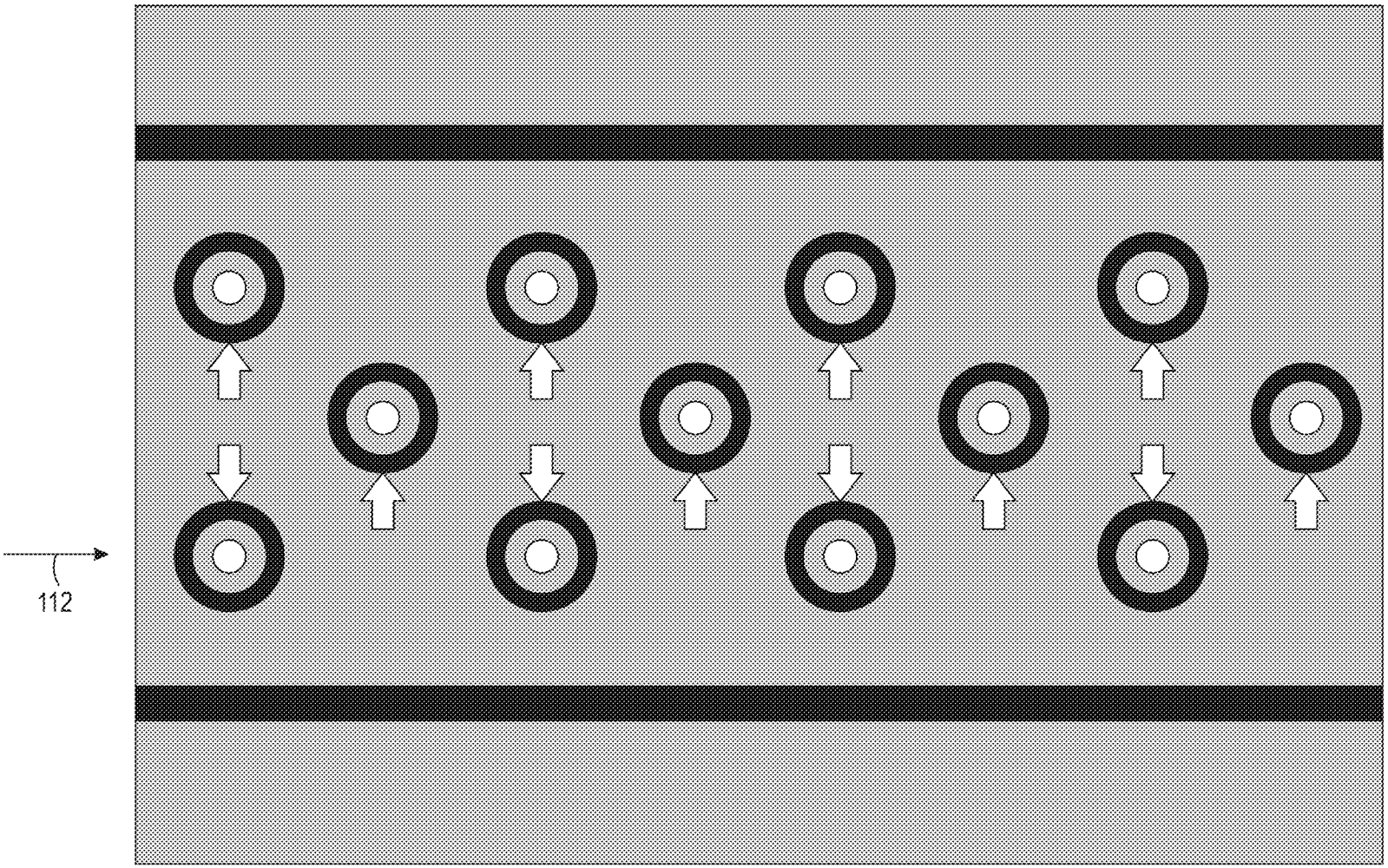
FIG. 5 (Prior Art)
FIG. 5 illustrates an artifact produced by drying an aqueous ink image on a substrate supported by a transport belt and platen in the prior art.

FIG. 2 is a top view of the belt diversion components 180, the platen 182, and the belts 164. The platen 182 covers the vacuum plenum 184, which is a five-sided box with side plates 244 and a bottom plate 248 (FIG. 3), and the belts 164 slide over the platen 182. The metal platen includes vacuum holes beneath the belt as is known in the art. The belt diversion components 180 are rollers with their rotational axes journaled in bearings 208 in the side plates 244 so the rollers extend across the plenum from one side to the other in the cross-process direction. Alternatively, they can be rollers having a length a little greater than the width of the belts 164 in the cross-process direction. As used in this document, the term "belt diversion component" means a device configured to divert a belt sliding over a platen from a straight-line path over the platen to increase the distance the belt travels with respect to the platen. Each end of the rotational axis of each roller 216 is journaled in bearings 208 positioned within flanges 212 extending from the bottom plate 248, as shown in FIG. 3. Also, the positioning of the rotational axis of a roller and the diameter of the roller extend the path of the belt by a distance in the process direction 112 that is greater than the diameter of the holes in the belt. This length ensures that the portion of the substrate adjacent to a hole prior to its diversion around a roller does not remain in synchronization with the hole. By undulating the belts with the belt diversion components, the time the belts are in contact with the substrates is reduced, which reduces the amount of heat transferred from the belts to the substrates. The number of belt diversion components needs to be sufficient to ensure that at least 20% of a substrate's surface over the platen is not touching the belt. Also, by disrupting the synchronization of the substrate portions with the holes in the belts, the circular artifacts shown in FIG. 5 and described above are averted.

Figure 4:
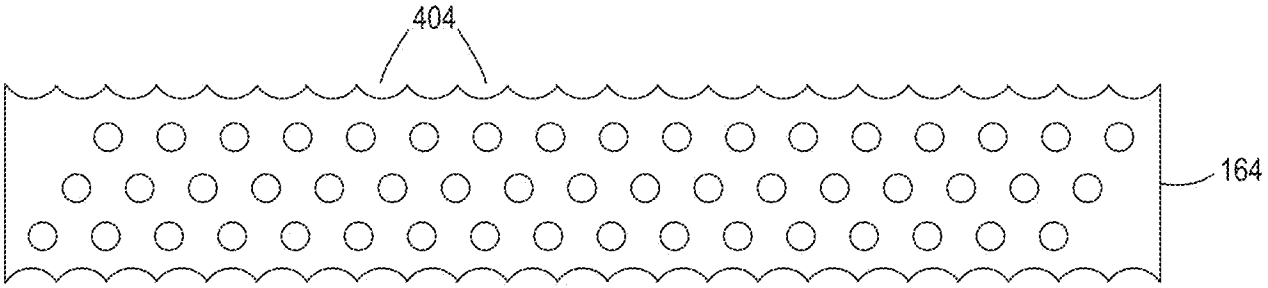
FIG. 4 is a top view of an alternative embodiment of the belts that slide over the platen of the dryer shown in FIG. 1.

With further reference to FIG. 2, the belt diversion components 180 are distributed over the surface of the platen in the areas supporting the belts in a manner that is irregular to maintain control of the substrate. As used in this document, the term "irregular" means an arrangement other than M rows and N columns and an arrangement that is not a pattern of rollers that repeats itself over the entire surface of the platen. An additional feature that can be included in the belts is the scalloped edge on each side of the belt as shown in FIG. 4. The scallop 404 has a diameter equal to the diameter of the belt holes. Thus, the belt diversion components keep the scalloped edges from synching with the same portions of the substrates and help prevent a straight line from occurring between regions having a temperature differential at the edges of the belts. As used in this document, the term "scalloped" means an edge of a belt that is not straight in the process direction.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

at least one printhead configured to eject drops of an ink onto substrates moving past the at least one printhead to form ink images on the substrates; and a dryer having:

a platen;

a heater configured to direct heat toward the platen;

at least one media transport belt configured to slide over the platen to move the substrates past the heater after the ink images have been formed on the substrates; and at least one belt diversion component configured to divert the at least one media belt from a straight-line path over the platen.

2. The inkjet printer of claim 1, the at least one belt diversion component further comprising:

a roller having a first and second end, the first end of the roller being journaled in a first bearing and the second end of the roller being journaled in a second bearing.

3. The inkjet printer of claim 2 wherein the first bearing is positioned within a first wall of a vacuum plenum and the second bearing is positioned within a second wall of the vacuum plenum, the first wall of the vacuum plenum being opposite the second wall of the vacuum plenum in a cross-process direction.

4. The inkjet printer of claim 2 further comprising:

a third wall that joins the first wall of the vacuum plenum to the second wall of the vacuum plenum;

two flanges extending from the third wall for each roller of the at least one belt diversion component; and the first bearing being positioned within one of the two flanges for each roller and the second bearing being positioned within the other of the two flanges for each roller, the two flanges for each roller being opposite one another in a cross-process direction.

5. The inkjet printer of claim 2 wherein each roller of the at least one belt diversion component is positioned beneath an opening in the platen.

6. The inkjet printer of claim 5 wherein a distance of travel for the at least one media transport belt from one side of the opening to the roller and to the opposite side of the opening in a process direction is greater than a diameter of the opening in the platen.

7. The inkjet printer of claim 6 wherein the at least one belt diversion component is a plurality of belt diversion components arranged irregularly in the platen.

8. The inkjet printer of claim 7 wherein the at least one media transport belt is a plurality of transport belts, each belt in the plurality of transport belts being separated from the other belts in the plurality of transport belts by a distance that exposes a portion of the platen between adjacent media transport belts.

9. The inkjet printer of claim 8 wherein each media transport belt is scalloped along each edge of the media transport belt that extends in the process direction.

10. The inkjet printer of claim 1 wherein the at least one belt diversion component is a plurality of belt diversion components and a number of belt diversion components in the plurality of belt diversion components is sufficient to separate a predetermined percentage of the at least one belt from the platen.

11. The dryer of claim 10, the at least one belt diversion component further comprising:

a roller having a first and second end, the first end of the roller being journaled in a first bearing and the second end of the roller being journaled in a second bearing.

12. The dryer of claim 11 wherein the first bearing is positioned within a first wall of a vacuum plenum and the second bearing is positioned within a second wall of the vacuum plenum, the first wall of the vacuum plenum being opposite the second wall of the vacuum plenum in a cross-process direction.

13. The dryer of claim 11 further comprising:

a third wall that joins the first wall of the vacuum plenum to the second wall of the vacuum plenum;

two flanges extending from the third wall for each roller of the at least one belt diversion component; and the first bearing being positioned within one of the two flanges for each roller and the second bearing being positioned within the other of the two flanges for each roller, the two flanges for each roller being opposite one another in a cross-process direction.

14. The dryer of claim 11 wherein each roller of the at least one belt diversion component is positioned beneath an opening in the platen.

15. The dryer of claim 14 wherein a distance of travel for the at least one media transport belt from one side of the opening to the roller and to the opposite side of the opening in a process direction is greater than a diameter of the opening in the platen.

16. The dryer of claim 15 wherein the at least one belt diversion component is a plurality of belt diversion components arranged irregularly in the platen.

17. The dryer of claim 16 wherein the at least one media transport belt is a plurality of transport belts, each belt in the plurality of transport belts being separated from the other belts in the plurality of transport belts by a distance that exposes a portion of the platen between adjacent media transport belts.

18. The dryer of claim 17 wherein each media transport belt is scalloped along each edge of the media transport belt that extends in the process direction.

19. A dryer for an inkjet printer comprising:

a platen;

a heater configured to direct heat toward the platen;

at least one media transport belt configured to slide over the platen to move substrates past the heater after ink images have been formed on the substrates; and at least one belt diversion component configured to divert the at least one media belt from a straight-line path over the platen.

20. The dryer of claim 19 wherein the at least one belt diversion component is a plurality of belt diversion components and a number of belt diversion components in the plurality of belt diversion components is sufficient to separate a predetermined percentage of the at least one belt from the platen.

* * * * *